US006019179A

United States Patent [19]

Zürbes

[11] Patent Number: 6,019,179

[45] Date of Patent: Feb. 1, 2000

[54] VIBRATION TAMPER

[75] Inventor: Arno Zürbes, Bruchweiler, Germany

[73] Assignee: Bomag GmbH, Boppard, Germany

[21] Appl. No.: 09/019,874

[22] Filed: Feb. 6, 1998

[30] Foreign Application Priority Data

Feb. 7, 1997 [DE] Germany ..... 197 04 495

[51] Int. Cl.[7] ..... E01C 19/34

[52] U.S. Cl. ..... 173/49; 173/162.2; 173/210

[58] Field of Search ..... 173/162.2, 162.1, 173/210, 211, 170, 49; 404/133.1, 133.05

[56] References Cited

U.S. PATENT DOCUMENTS

| | | | |
|---|---|---|---|
| 4,186,197 | 1/1980 | Tetsuo | 404/133.1 |
| 5,645,370 | 7/1997 | Züres et al. | 404/133.1 |

FOREIGN PATENT DOCUMENTS

| | | |
|---|---|---|
| 44 33 243 A1 | 3/1996 | Germany . |
| 44 36 081 A1 | 4/1996 | Germany . |
| 44 45 188 A1 | 6/1996 | Germany . |

OTHER PUBLICATIONS

Advertisement Wacker—Electro–Ruttel–Stampfer (Model ES200) (3 pages) (date unknown–circa 1945).

Dubbel—Taschenbuch fur den Machinenbau, p. B37 (Admitted prior art) (translation attached).

*Primary Examiner*—Peter Vo

*Assistant Examiner*—James P Calve

*Attorney, Agent, or Firm*—Akin, Gump, Strauss, Hauer & Feld, L.L.P.

[57] ABSTRACT

A vibration tamper for soil compacting has a guide handle proceeding from the tamper head, which is pivoted elastically on the tamper. At the same time, the handle has a special mass distribution with regard to its pivot point.

9 Claims, 2 Drawing Sheets

VIBRATION TAMPER

BACKGROUND OF THE INVENTION

The invention concerns a tamper for soil compacting, which executes approximately vertical vibrations through a built-in drive, and thereby can be held by an operator through a guide handle elastically pivoted on the tamper head and having a grip end, whereby the mass distribution of the guide handle brings about a reduction of the vibrations on the grip end.

Tampers are known in numerous construction variants and have proven themselves well in compacting small surfaces. Through the guide handle the operator is in a position to guide the vibrating tamper over the soil surfaces to be compacted in the desired direction and at the desired speed with little expenditure of energy.

Of course, the tamper vibrations are also transferred to the guide handle. The operator therefore is more or less often forced to take a break, depending on the intensity and frequency of the vibration and as a function of the quality of the damping element between guide handle and tamper.

An advantageous solution for damping the vibrations occurring in the guide handle is known from DE 44 36 081 A 1. Here the tamper has an extension of the guide handle opposite the grip end extending over its pivot point, which serves among other things for protection, or as an additional handle during transport. In particular, however, it is called upon in this published patent application to adjust the mass distribution of the guide handle, which largely compensates for the vibrations occurring in the handle.

BRIEF SUMMARY OF THE INVENTION

Proceeding from this background, an object of the present invention lies in improving the known tamper, such that the guide handle lies even more quietly in the hand with the same compacting output of the tamper. The operator is thus subjected to even less stress, and interruptions of operations can be reduced. For this purpose, vibration phenomena, in particular, should be more extensively taken into consideration, and the solution should be suited for tampers whose guide handle has no extension opposite the grip end. The guidance or control possibility of the tamper should, at the same time, be preserved to the full extent.

This object is accomplished in accordance with the invention, in that the geometry of the guide handle complies essentially with the following mathematical equation:

$$\frac{\Theta_s}{m_s(l_{HG}\cdot l_H - l_v\cdot l_v)} = 0.8 - 1.3 \text{ (quotient)}$$

wherein $m_s$=the mass of the guide handle, $\Theta_s$=the inertial moment of the guide handle around an axis through the center of gravity of the guide handle parallel to an axis leading through the pivot points, $l_H$=the distance perpendicular to the tamper axis between the axis leading through the pivot points and the center of gravity, $l_{HG}$=the distance perpendicular to the tamper axis between the grip end and the center of gravity, and $l_v$=the distance parallel to the tamper axis between the axis leading through the pivot points and the center of gravity. The term "0.8–1.3 (quotient)," as used in the specification, should be interpreted to mean a unitless number within a range between 0.8 and 1.3.By guide handle will be chiefly understood the handle including its attached elements (tank, grip, handle, etc.).

To the extent that the guide handle has an extension, a mass distribution of the handle, which, should also comply at the same time with DE 44 36 081 A 1, is expressly excluded from the protection of the present application.

The applicant has conducted extensive experiments with respect to the transmission of vibration from the tamper to the guide handle, and came to the realization therefrom that it is less the elastic pivoting on the tamper and more the position of the pivot point and/or the mass distribution of the guide handle which can exert a decisive influence on the transmission of vibration. Applicant has hereby determined that by shifting the center of gravity of the guide handle downwardly and by distributing its mass in the manner described, a clear diminution of vibrations occurs on the grip end, if in this case the inherent torsion frequency of the handle in relation to the frame is less than $1/\sqrt{2}$ of the operating frequency of the tamper. The dynamic torque of the guide handle is thereby influenced in such a way, that the translational and rotational motions, which overlie each other on the grip end, almost cancel each other.

In a further embodiment of the invention, it is recommended to set the quotient for the aforesaid weight distribution equation at approximately 0.9 to 1.3, especially approximately 1.0 to 1.15.

In this connection, it is particularly beneficial if the guide handle carries a weight for realizing the desired mass distribution. This weight can be advantageously constructed in the form of brackets, handles, grips, protective frames or spacers.

The vertical motions in the handle, in particular, are reduced owing to the mass distribution of the invention. It is very advantageous for this reason to construct the handle further such that even the horizontal motions clearly decrease. This is achieved by arranging the pivot point of the guide handle on the tamper head above an imaginary perpendicular line proceeding from the grip area of the handle to the tamper axis.

Finally, bringing about the pivoting of the guide handle on the tamper head in an inherently known manner by at least one elastic element with a graduated progressive characteristic spring curve is recommended. This graduated progressive characteristic spring curve can be realized by additional damping surfaces of the elastic element, which are spaced in relation to the retaining handle in the resting position, and first enter into an operative connection with it following a certain deflection of the guide handle.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
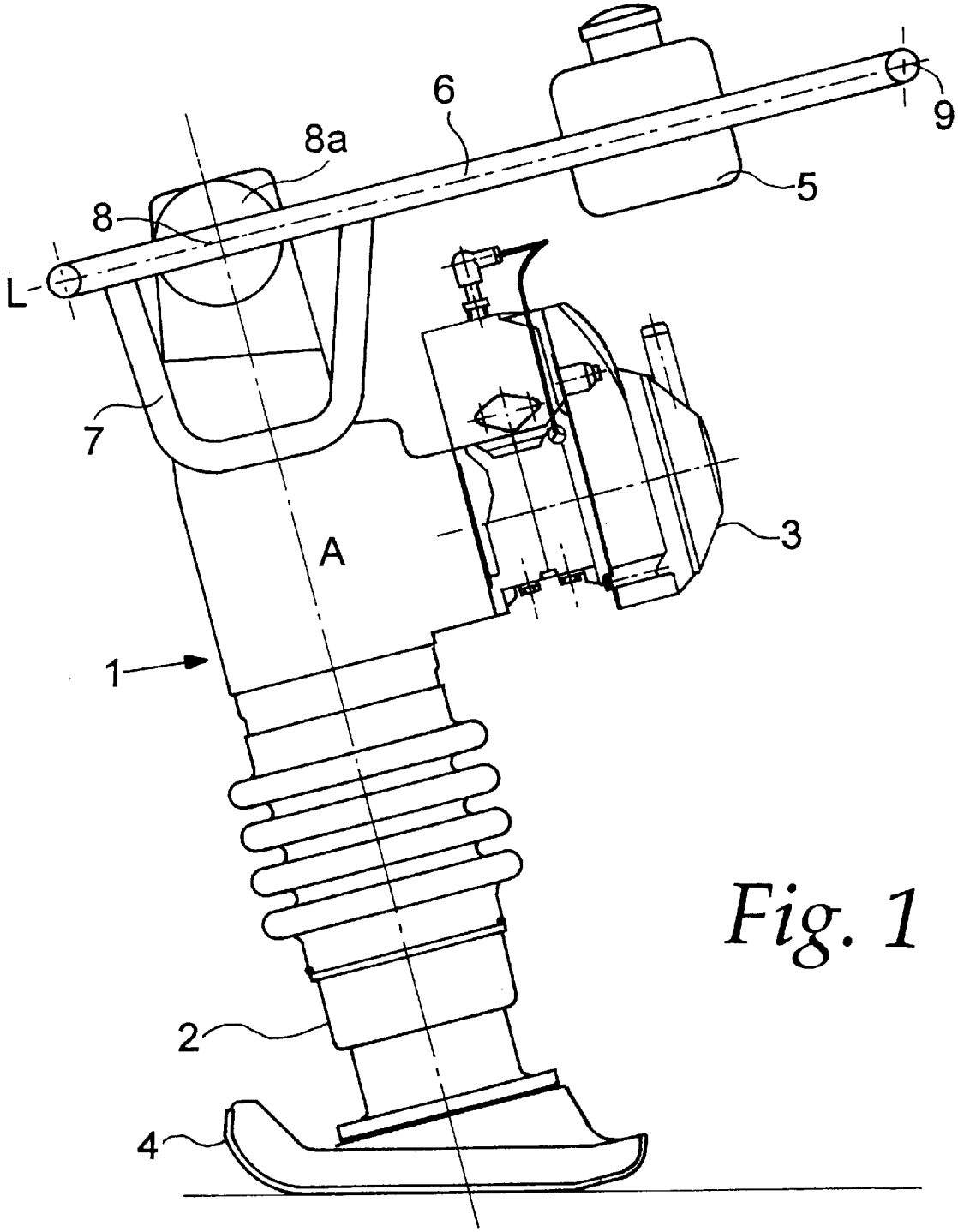
FIG. 1 is a side view of a tamper according to the invention.

The overall view in FIG. 1 depicts a basically conventional vibration tamper 1, whose tamper foot 2 is set into approximately vertical vibrations by a liquid fuel motor 3. For this, the motor 3 drives an eccentric, not depicted in greater detail, on which, for its part, a piston rod is fixed, which is braced on its lower end by prestressed springs and by the tamper foot 2.

The lower end of the tamper foot 2 is formed by an obliquely attached tamper plate 4, so that the tamper stands slightly forwardly inclined, at an angle of about 75° in the embodiment. Its equilibrium is thereby preserved, in that the drive motor 3 as well as the liquid fuel tank 5 are arranged on the other side of the tamper.

First, it is now essential that the guide handle 6 has a certain mass distribution, which is in compliance with the mathematical equation indicated further above. In order to obtain this mathematical relationship, brackets 7 running downwardly are arranged on both sides of the guide handle 6.

Figure 2:
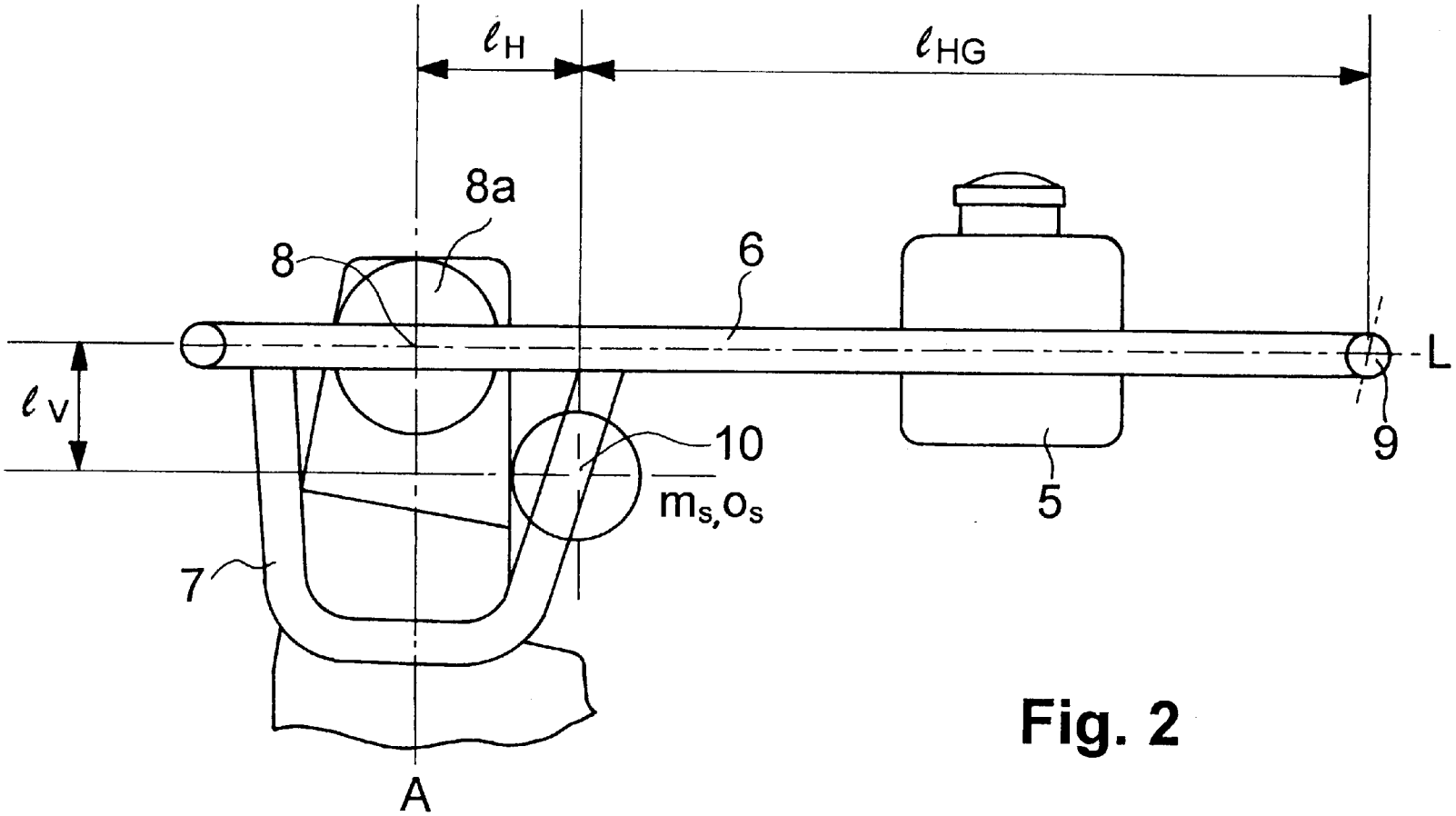
FIG. 2 is a schematic representation of the mass distribution on the guide handle.

For clarification of the individual masses and lever arms, reference is made to FIG. 2. There, the guide handle 6 is shown with an elastic element 8*a* with a graduated progressive characteristic spring curve, whereby the vibrations from the tamper are introduced into the bracket via a pivot point 8. These vibrations do not run exactly vertically, but rather along a complicated curved path. Therefore, the grip end 9 is not only exposed to motions in a vertical direction, but also in a horizontal direction. The vertical motions are essentially reduced or eliminated through the mass distribution of the invention, since with this the inherent torsion frequency of the guide handle in relation to the machine frame is less than $1/\sqrt{2}$ of the operative frequency.

In order to guarantee this, the center of gravity 10 of the guide handle 6 is positioned so that it is situated at the distance $l_v$ below or above an imaginary line through the center between the pivot points 8 and through the grip end 9.

Furthermore, the inertial moment of the guide handle around an axis through the center of gravity 10 parallel to the two pivot points 8 must, especially with an empty tank, stand in the following relationship to the mass of the guide handle and the distances indicated:

$$\frac{\Theta_s}{m_s(l_{HG}\cdot l_H - l_v\cdot l_v)} = 0.8 - 1.3 \text{ (quotient)}$$

wherein particularly:

$m_S$=the mass of the guide handle 8 along with attached elements;

$\Theta_S$=the inertial moment of the guide handle 6 around a horizontal axis, running perpendicular to the travel direction of the tamper 1, through the center of gravity 10 of the guide handle;

$l_H$=the length of the projection of the distance between the center of gravity 10 and an imaginary axis through the pivot points 8 on a plane running through pivot points 8 and grip end 9;

$l_{HG}$=the length of the projection of the distance between the center of gravity 10 and the grip end 9 on the plane running through pivot points 8 and grip end 9; and $l_v$=the distance of the center of gravity 10 from the plane running through pivot points 8 and grip end 9.

If this mathematical relationship is maintained, the motion at the grip end 9 of the guide handle 6 is hardly still noticeable in the travel direction travel of the machine frame, as well as transversely to it.

In addition, the Figures show that the guide handle 6 is extended forward beyond the pivot point 8. It can carry counterweights there, by which the desired mass distribution can be brought about in a simple manner with the handle geometry remaining constant.

The distribution of mass can, however, be realized in an especially advantageous manner by means of a bracket 7 which, at the same time, serves as a transport grip, protective frame and/or spacer.

If the horizontal motions of the grip end are also to be essentially diminished in addition to the vertical, then one must furthermore arrange the pivot point 8 of the guide handle 6 on the tamper head above an imaginary perpendicular line L proceeding from the grip end 9 of the guide handle 6 on the tamper axis A. This has not yet been taken into consideration in the embodiment represented in the Figures. Here the pivot point 8 lies exactly at the height of the perpendicular line L.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A tamper for soil compacting, comprising a built-in drive (3) which executes approximately vertical vibrations of a tamper foot (2), a guide handle (6) for operatingly holding the tamper, said guide handle (6) having a bracket means (7) attached thereto and being rigidly mounted on a tamper axis (A) of said tamper and elastically pivoted about an axis perpendicular to said tamper axis (A) on at least one pivot point (8) and having a grip end (9), wherein a mass distribution of the guide handle brings about a reduction of vibrations at the grip end, the mass distribution and a geometry of the guide handle satisfy the following equation:

$$\frac{\Theta_s}{m_s(l_{HG}\cdot l_H - l_v\cdot l_v)} = 0.8 - 1.3 \text{ (quotient)}$$

wherein:

$m_S$=mass of the guide handle (6);

$\Theta_S$=inertial moment of the guide handle (6) around an axis through a center of gravity (10) of the guide handle (6), which extends parallel to an axis leading through the pivot point (8);

$l_H$=distance perpendicular to the tamper axis (A) between the axis leading through the pivot point (8) and the center of gravity (10);

$l_{HG}$=distance perpendicular to the tamper axis (A) between the grip end (9) and the center of gravity (10); and $l_v$=distance parallel to the tamper axis (A) between the axis leading through the pivot point (8) and the center of gravity (10).

2. The tamper according to claim 1, wherein the mass distribution and the geometry of the guide handle satisfy the following equation:

$$\frac{\Theta_s}{m_s(l_{HG}\cdot l_H - l_v\cdot l_v)} = 0.9 - 1.3$$

3. The tamper according to claim 1, wherein the mass distribution and the geometry of the guide handle satisfy the following equation:

$$\frac{\Theta_s}{m_s(l_{HG} \cdot l_H - l_v \cdot l_v)} = 1.0 - 1.15$$

4. The tamper according to claim 1, wherein the weight has a form selected from group consisting of a bracket (7), handle, protective frame and spacer.

5. The tamper according to claim 1, wherein the pivot point (8) is arranged on the tamper head (2) on the tamper axis (A) above an imaginary perpendicular line (L) proceeding from the grip end (9) of the handle (6).

6. The tamper according to claim 1, wherein the pivot point (8) comprises at least one elastic element **(8*a*)** with a graduated progressive characteristic spring curve.

7. A tamper for soil compacting, comprising a built-in drive (3) which executes approximately vertical vibrations of a tamper foot (2), a rigid guide handle (6) having a bracket means (7) attached thereto and being mounted on a tamper axis (A) of said tamper and being elastically pivoted about an axis perpendicular to said tamper axis (A) on at least one pivot point (8) and having a grip end (9), wherein a mass distribution of the guide handle yields a reduction of vibrations at the grip end, when the mass distribution and a geometry of the guide handle satisfy the following equation:

$$\frac{\Theta_s}{m_s(l_{HG} \cdot l_H - l_v \cdot l_v)} = X$$

wherein:

X=a unitless number within a range between 0.8 and 1.3;

$m_S$=mass of the guide handle (6);

$\Theta_S$=inertial moment of the guide handle (6) around a center of gravity (10) of the guide handle (6), a first axis extending through the center of gravity and being parallel to the guide handle (6), a second axis extending through the center of gravity, being perpendicular to the first axis and being parallel to the tamper axis (A);

$l_H$=distance perpendicular to tamper axis (A) between a center of the pivot point (8) and the center of gravity (10);

$l_{HG}$=distance perpendicular to the tamper axis (A) between the grip end (9) and the center of gravity (10); and $l_v$=distance parallel to the tamper axis (A) between a center of the guide handle (6) and the center of gravity (10).

8. The tamper of claim 7, wherein X is a unitless number within a range between 0.9 and 1.3.

9. The tamper of claim 7, wherein X is a unitless number within a range between 1.0 and 1.15.

* * * * *